US007245846B2

(12) United States Patent
Seorl et al.

(10) Patent No.: US 7,245,846 B2
(45) Date of Patent: Jul. 17, 2007

(54) OXIDATION CATALYST UNIT AND A WET-TYPE ELECTROPHOTOGRAPHIC IMAGE FORMING APPARATUS COMPRISING THE SAME AND A METHOD THEREOF

(75) Inventors: Kwoang-joe Seorl, Suwon-si (KR); Joong-hwan Choi, Seoul (KR); Young-joon Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 125 days.

(21) Appl. No.: 10/936,706

(22) Filed: Sep. 9, 2004

(65) Prior Publication Data

US 2005/0244183 A1 Nov. 3, 2005

(30) Foreign Application Priority Data

Apr. 28, 2004 (KR) ..... 10-2004-0029391

(51) Int. Cl.
*G03G 15/20* (2006.01)
*G03G 21/00* (2006.01)

(52) U.S. Cl. ..... 399/93

(58) Field of Classification Search ..... 399/91–93
See application file for complete search history.

(56) References Cited

U.S. PATENT DOCUMENTS 4,415,533 A * 11/1983 Kurotori et al. ..... 422/4
4,538,899 A * 9/1985 Landa et al. ..... 399/156
4,760,423 A * 7/1988 Holtje et al. ..... 399/250
2004/0047645 A1* 3/2004 No et al. ..... 399/93

FOREIGN PATENT DOCUMENTS

| | | | |
|---|---|---|---|
| JP | 54111832 A | * | 9/1979 |
| JP | 05023536 A | * | 2/1993 |
| JP | 09138619 A | * | 5/1997 |
| JP | 2002-139917 | | 5/2002 |
| KR | 10-00247987 | | 12/1999 |
| KR | 10-0400020 | | 9/2003 |

* cited by examiner

*Primary Examiner*—David M. Gray
*Assistant Examiner*—Ryan Gleitz
(74) *Attorney, Agent, or Firm*—Roylance, Abrams, Berdo & Goodman, L.L.P.

(57) ABSTRACT

An oxidation catalyst unit for a wet-type electrophotographic image forming apparatus which filters a vapor produced at a fusing unit and a method thereof are provided. The oxidation catalyst unit and method includes a duct for guiding the carrier vapor produced at the fusing unit into the oxidation catalyst unit, a heater for heating the carrier vapor being guided along the duct, an oxidation catalyst carrying medium disposed behind the heater for catalyzing an oxidation reaction of the carrier vapor guided along the duct, and an absorbent filter for preventing entry of the carrier vapor into the oxidation catalyst in the form of liquid drops.

24 Claims, 6 Drawing Sheets

OXIDATION CATALYST UNIT AND A WET-TYPE ELECTROPHOTOGRAPHIC IMAGE FORMING APPARATUS COMPRISING THE SAME AND A METHOD THEREOF

CROSS-REFERENCE TO RELATED APPLICATIONS

This application claims the benefit under 35 U.S.C. 119(a) of Korean Patent Application No. 2004-29391, filed Apr. 28, 2003, in the Korean Intellectual Property Office, the entire contents of which are incorporated herein by reference.

BACKGROUND OF THE INVENTION

1. Field of the Invention

The present invention relates to a wet-type electrophotographic image forming apparatus. More particularly, the present invention relates to an oxidation catalyst unit for removing a carrier vapor produced at a fusing unit by oxidizing, and a wet-type electrophotographic image forming apparatus comprising the same and a method thereof.

2. Description of the Related Art

An electrophotographic image forming apparatus scans a laser beam on a photoconductive medium to form an electrostatic latent image, and transfers a visible image formed by attaching a developer onto the electrostatic latent image, thereby printing a desired image.

A wet-type electrophotographic image forming apparatus uses a liquid developer while a dry-type electrophotographic image forming apparatus uses a powder toner. The wet-type electrophotographic image forming apparatus can implement a clearer image, and even a color image of high quality.

The developers consist of a toner and a liquid carrier such as norpar. The norpar is a hydrocarbon-based solvent which is a mixture of $C_{10}H_{22}$, $C_{11}H_{24}$, $C_{12}H_{26}$, and $C_{13}H_{28}$.

Paper having the developer passes through a fusing unit and causes the toner component in the developer to adhere on the paper, and the liquid carrier such as the norpar is vaporized by a high temperature and discharged in the form of a combustible hydrocarbon gas such as $CH_4$.

The combustible hydrocarbon gas is one of a volatile organic compound (VOC), which contaminates the environment and emits an offensive odor when discharged. Therefore, various methods for removing combustible hydrocarbon gas have been introduced.

Methods for removing combustible hydrocarbon gases known in the art include a filtration method for physically removing gaseous components using a carbon filter such as active carbon, a direct combustion method for combusting gaseous components at an ignition point (approximately 600° C. to 800° C.), and a catalytic oxidation method for combusting gaseous components at a relatively lower temperature (approximately 150° C. to 400° C.) using a catalyst, thereby oxidizing and resolving the components into water and carbon dioxide.

In the filtration method, the carbon filter does not have a capability of resolving the carrier vapors entrained. Therefore, the carbon filter saturated with carrier vapors needs to be replaced with a new one when the carrier vapors are entrained over a predetermined amount in the carbon filter, and such replacement should be frequently made. Furthermore, the direct combustion method is not safe due to the high temperatures generated. Due to the above problems, recently, wet-type electrophotographic image forming apparatus have mainly employed the catalytic oxidation method for removing the carrier vapors.

FIG. 1 is a schematic view of a conventional oxidation catalyst unit. The oxidation catalyst unit 160 comprises a duct 161, a fan 162, a heater 163, and an oxidation catalyst carrying medium 164.

The duct 161 is connected to one side of a fusing unit 150, and guides a carrier vapor V into the oxidation catalyst unit 160 in order to remove the carrier vapor V produced in the fusing unit 150.

The fan 162 is mounted in the duct 161 to forcibly send the carrier vapor V toward the oxidation catalyst carrying medium 164.

The heater 163 raises the temperature of the carrier vapor V up to an activating temperature, for example, 200° C. The oxidation catalyst carrying medium 164 carries a catalyst such as Pt and Pd, which catalyzes an oxidization reaction. The oxidation catalyst carrying medium 164 is mounted behind the heater 163.

The carrier vapor V is partially cooled and condensed in the duct 161 while moving to the oxidation catalyst carrying medium 164. In the conventional oxidation catalyst unit 160, although the condensed carrier vapor V passes through the heater 163, the carrier vapor V does not completely vaporize.

Therefore, the condensed carrier vapor V gets absorbed into a surface of the catalyst in the oxidation catalyst carrying medium 164, in the form of liquid drops 170, thereby diminishing the effectiveness of the catalyst.

SUMMARY OF THE INVENTION

An aspect of the present invention is to solve at least the above problems and disadvantages and to provide at least the advantages described below. Accordingly, an aspect of the present invention is to provide an oxidation catalyst unit having an improved function, and a wet-type electrophotographic image forming apparatus having the same and a method thereof.

In order to achieve the above-described aspects of the present invention, there is provided an oxidation catalyst unit comprising a duct, a heater, an oxidation catalyst carrying medium, and an absorbent filter. The duct guides a carrier vapor produced at a fusing unit to the oxidation catalyst unit. The heater heats the carrier vapor being guided along the duct. The oxidation catalyst carrying medium is disposed behind the heater to catalyze an oxidation reaction of the carrier vapor guided along the duct. The absorbent filter prevents the carrier vapor, being condensed, from entering the oxidation catalyst carrying medium.

The absorbent filter comprises one of zeolite, $\gamma$-$Al_2O_3$, $\gamma$-$TiO_2$, $\gamma$-$SiO_2$, $\gamma$-$ZrO_2$ and $\gamma SiO_2$—$Al_2O_3$, or a compound comprising at least two of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

The absorbent filter is disposed before the heater, or between the heater and the oxidation catalyst carrying medium. If a plurality of theaters are provided, the absorbent filter is disposed between the plurality of heaters.

In order to achieve another aspect of the present invention, there is provided a wet-type electrophotographic image forming apparatus comprising a photoconductive medium, a laser scanning unit, a developing unit, a transfer unit, a fusing unit and an oxidation catalyst unit. The laser scanning unit scans a laser beam on the photoconductive medium. The developing unit develops a developer on the photoconductive medium. The transfer unit transfers the developed developer onto a paper. The fusing unit fuses the developer onto the paper. The oxidation catalyst unit oxidizes and resolves a carrier vapor produced at the fusing unit. The oxidation catalyst unit comprises a duct, a heater, an oxidation catalyst carrying medium and an absorbent filter. The duct guides the carrier vapor produced at the fusing unit into the oxidation catalyst unit. The heater heats the carrier vapor being guided along the duct. The oxidation catalyst carrying medium is disposed behind the heater to catalyze an oxidation reaction of the carrier vapor guided along the duct. The absorbent filter prevents entry of the carrier vapor into the oxidation catalyst in the form of liquid drops.

The absorbent filter comprises one of zeolite, $\gamma$-$Al_2O_3$, $\gamma$-$TiO_2$, $\gamma$-$SiO_2$, $\gamma$-$ZrO_2$ and $\gamma SiO_2$—$Al_2O_3$, or a compound comprising at least two of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

The absorbent filter is disposed before the heater, or between the heater and the oxidation catalyst carrying medium. When a plurality of heaters are provided, the absorbent filter is disposed between the heater and the oxidation catalyst carrying medium.

BRIEF DESCRIPTION OF THE DRAWING FIGURES

The above aspect and other features of the present invention will become more apparent by describing in detail exemplary embodiments thereof with reference to the accompanying figures, wherein.

Throughout the drawings, it should be noted that the same or similar elements are denoted by like reference numerals.

DETAILED DESCRIPTION OF THE EXEMPLARY EMBODIMENTS

Hereinafter, embodiments of the present invention will be described in detail with reference to the accompanying figures. Specific matters defined in the description such as a detailed construction and elements are exemplary and are used to provide a comprehensive understanding of the invention. Thus, it should be apparent that the present invention can be performed in a manner other than the described examples. Also, well-known functions or constructions are not described in detail since they would unnecessarily obscure the invention.

Figure 2:
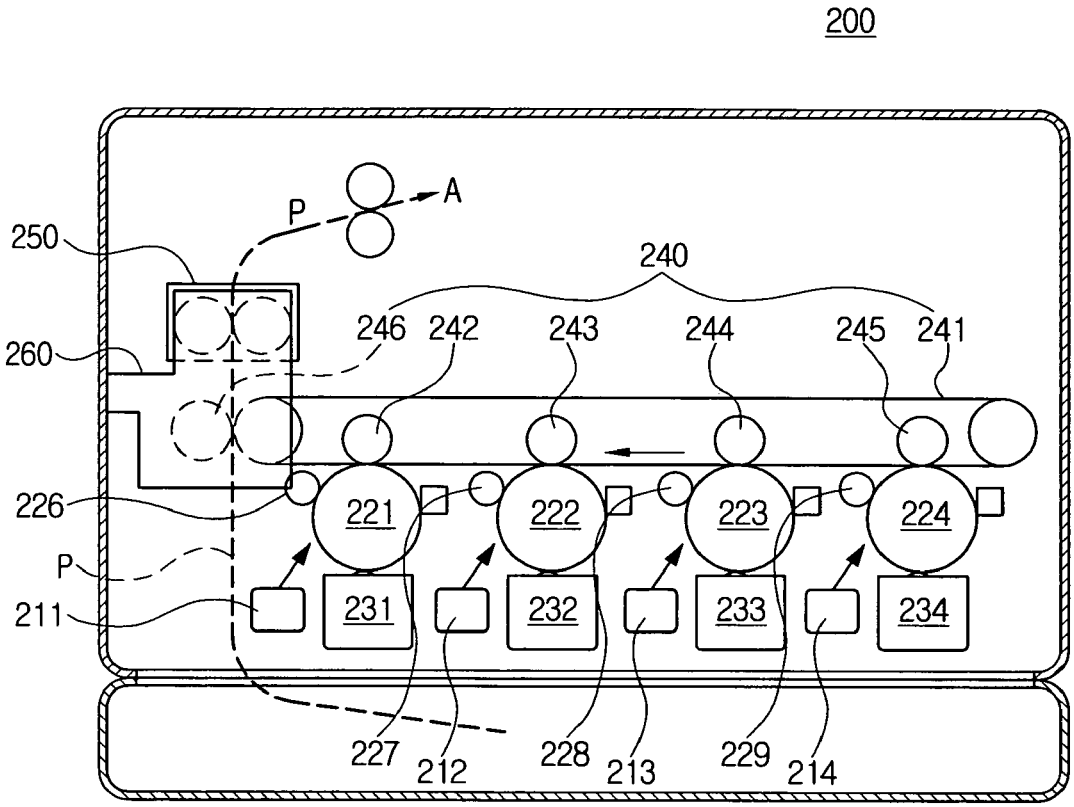
FIG. 2 is a schematic view illustrating a wet-type electrophotographic image forming apparatus according to an embodiment of the present invention.

FIG. 2 schematically illustrates an exemplary wet-type electrophotographic image forming apparatus according to an embodiment of the present invention. The wet-type electrophotographic image forming apparatus 200 comprises a plurality of laser scanning units 211, 212, 213 and 214, a plurality of photoconductive drums 221, 222, 223 and 224, a plurality of electrification units 226, 227, 228 and 229, a plurality of developing units 231, 232, 233 and 234, a transfer unit 240, a fusing unit 250, and an oxidation catalyst unit 260.

The plurality of laser scanning units 211, 212, 213 and 214 scan a laser beam onto the photoconductive drums 221, 222, 223 and 224 which are electrified to a predetermined electric potential by the electrification units 226, 227, 228 and 229.

Surfaces of the photoconductive drums 221, 222, 223 and 224 are coated with a photoconductive sensitization layer, and therefore, differences in the electric potentials are caused on the surfaces of the photoconductive drums 221, 222, 223 and 224 scanned with the laser beam, accordingly forming an electrostatic latent image.

The developing units 231, 232, 233 and 234 supply the developer respectively to the photoconductive drums 221, 222, 223 and 224. The developing units 231, 232, 233 and 234 respectively store developers of different colors such as yellow, magenta, cyan and black. Upon formation of the electrostatic latent image on the photoconductive drums 221, 222, 223 and 224, the developing units 231, 232, 233 and 234 transfer the respective color developers onto the photoconductive drums 221, 222, 223 and 224.

Accordingly, visible images are formed by the developers on the surfaces of the respective photoconductive drums 221, 222, 223 and 224. The developers comprise a toner for developing the electrostatic latent image and a liquid carrier for assisting movement of the toner.

The transfer unit 240 transfers the visible images formed on the photoconductive drums 221, 222, 223 and 224 onto paper. The transfer unit 240 comprises a transfer belt 241, first transfer rollers 242, 243, 244 and 245, and a second transfer roller 246. As shown in FIG. 2, the transfer belt 241 receives the visible images while operating in contact with the surfaces of the photoconductive drums 221, 222, 223 and 224.

The respective first transfer rollers 242, 243, 244 and 245 are mounted in relation to the photoconductive drums 221, 222, 223 and 224 in order to transfer the visible images on the photoconductive drums 221, 222, 223 and 224 onto the transfer belt 241. The developers comprising different colors such as yellow, magenta, cyan and black overlap with one another on the transfer belt 241, thereby forming a color image. The second transfer roller 246 transfers the color image formed on the transfer belt 241 onto paper.

The fusing unit 250 applies heat and pressure to the paper to affix the color image formed on the transfer belt 241 onto the paper. During the application of heat and pressure, the liquid carrier of developer components is vaporized, thereby generating a carrier vapor V.

Figure 4:
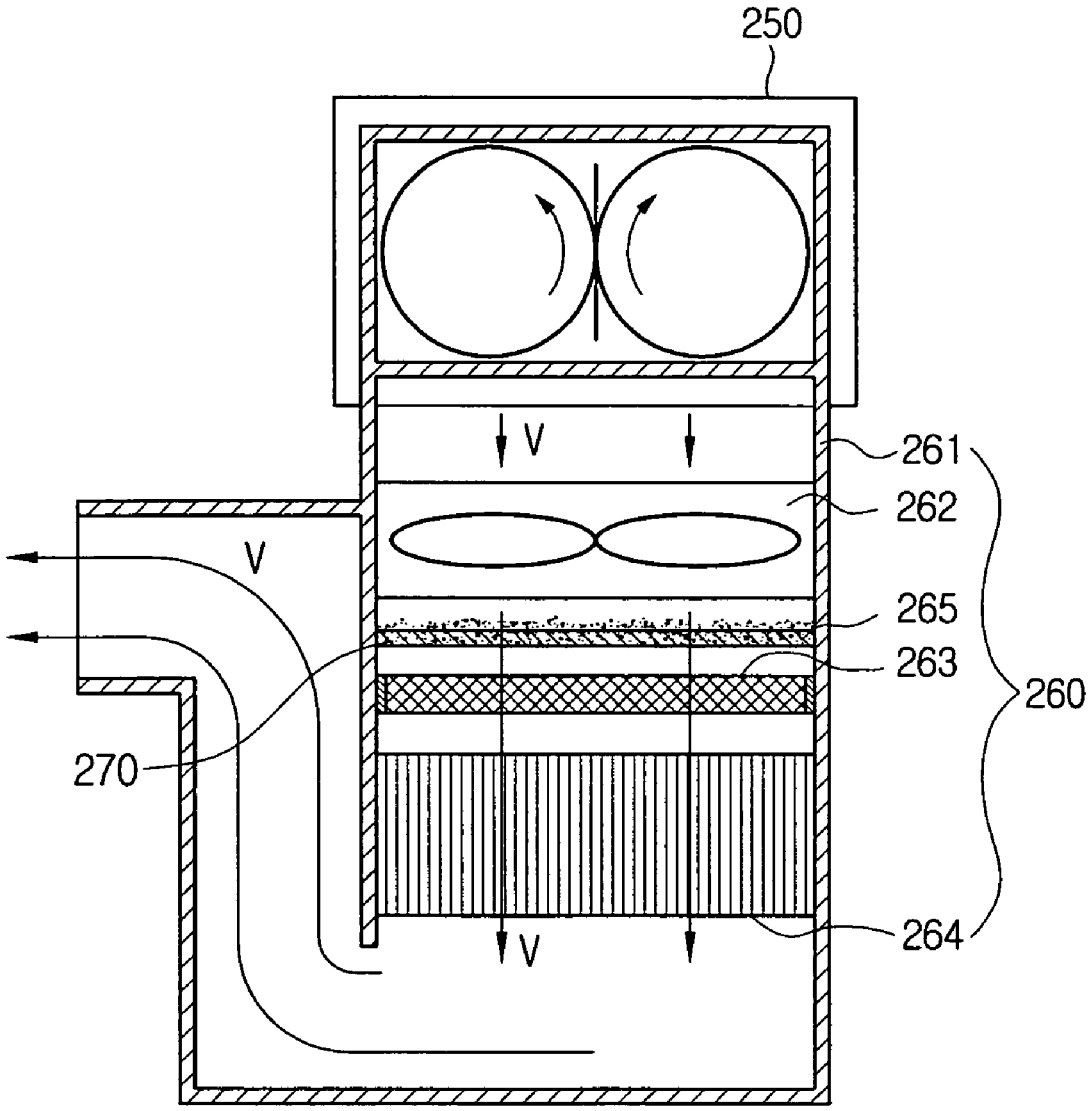
FIG. 4 is a sectional view illustrating the oxidation catalyst unit and the fusing unit of FIG. 3 cut along a line IV-IV.

The oxidation catalyst unit 260 drives the fan 262 (FIG. 4) to forcibly send the carrier vapor V generated at the fusing unit 250 toward an absorbent filter 265 (FIG. 4). The carrier vapor V, passing through the absorbent filter 265 (FIG. 4) and an oxidation catalyst carrying medium 264 (FIG. 4), is oxidized into water and carbon dioxide and discharged out of the duct 261 (FIG. 4).

Figure 3:
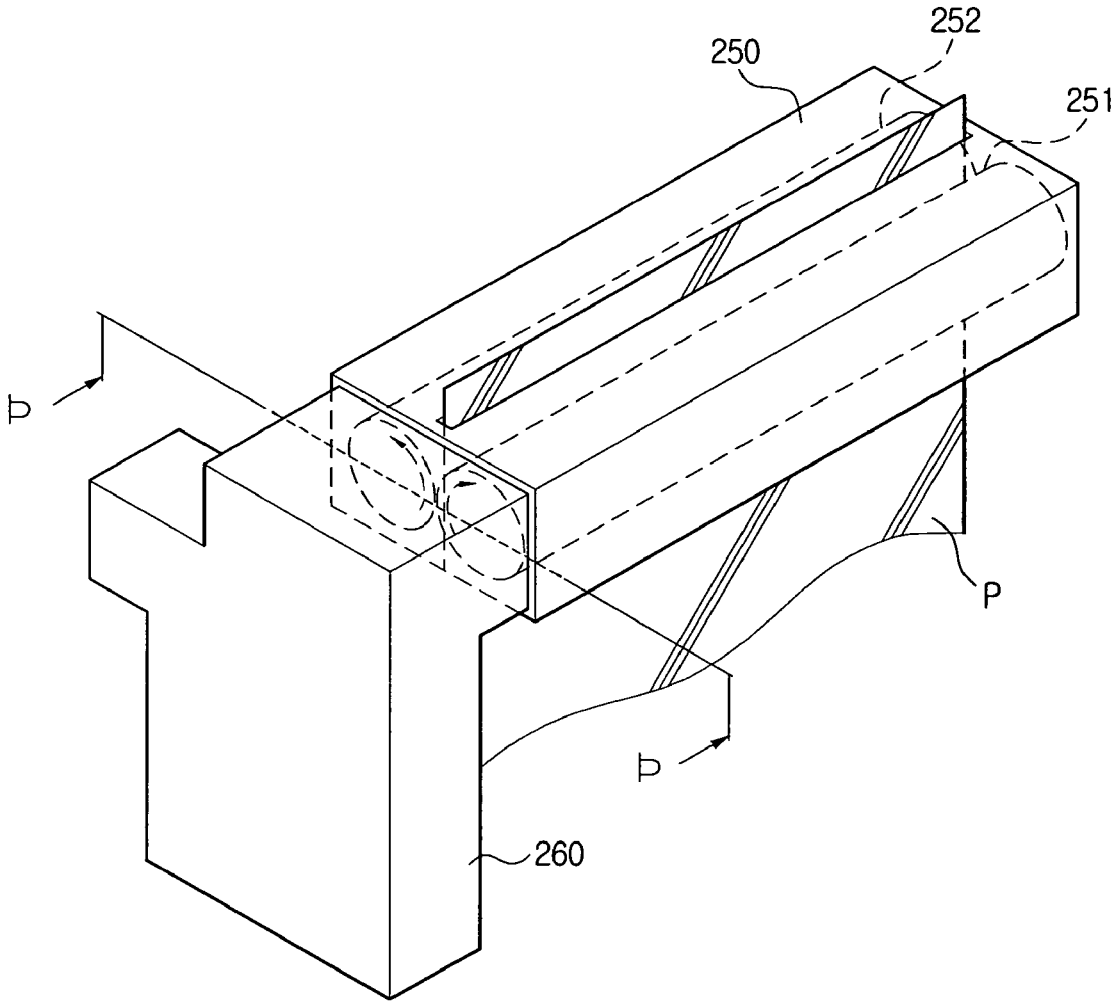
FIG. 3 is a perspective view illustrating a relationship between an oxidation catalyst unit and a fusing unit of FIG. 2.

FIG. 3 is a perspective view illustrating a relationship between the oxidation catalyst unit and the fusing unit of FIG. 2. The fusing unit 250 comprises a heating roller 251 and a pressing roller 252 which are in tight contact with each other, and the paper P passes through therebetween.

When the paper P passes through the fusing unit 250, the toner in the developers is affixed onto the paper P while the liquid carrier such as the norpar is vaporized in the form of a combustible hydrocarbon gas such as $CH_4$ via a high temperature.

For the oxidation and discharge of the hydrocarbon gas, the fusing unit 250 has the oxidation catalyst unit 260 at one side thereof. The structure and the operation of the oxidation catalyst unit 260 will be described hereinbelow.

FIG. 4 is a sectional view of the oxidation catalyst unit and the fusing unit cut along a line IV-IV of FIG. 3. The oxidation catalyst unit 260 comprises a duct 261, a fan 262, an absorbent filter 265, a heater 263 and an oxidation catalyst carrying medium 264.

The duct 261 guides the carrier vapor V produced at the fusing unit 250 into the oxidation catalyst unit 260.

The fan 262 is mounted at an inlet of the duct 261 to forcibly send the carrier vapor V generated in the fusing unit 250 toward the oxidation catalyst carrying medium 264.

The absorbent filter 265 is mounted behind the fan 262 within the duct 261 to prevent entry of the carrier vapor V, in the form of liquid drops 270, into the oxidation catalyst.

The heater 263 is mounted behind the absorbent filter 265 within the duct 261 to heat the carrier vapor V passed through the absorbent filter 265.

The oxidation catalyst carrying medium 264 is mounted behind the heater 263 within the duct 261 to catalyze an oxidation reaction of the carrier vapor V.

The absorbent filter 265 comprises one of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$, or a compound comprising at least two of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

According to the above structure, when the paper P passes through the fusing unit 250, the toner in the developers is affixed onto the paper P while the liquid carrier such as norpar is vaporized in the form of a combustible hydrocarbon gas such as $CH_4$ by the high temperature.

The carrier vapor V is guided into the oxidation catalyst unit 260 along the duct 261 connected to the fusing unit 250. At this time, the fan 262 mounted in the oxidation catalyst unit 260 forcibly sends the carrier vapor V toward the heater 263.

The carrier vapor V passes through the absorbent filter 265. During this process, the liquid drops 270 formed by the carrier vapor V which is partially condensed in the duct 261 is absorbed into the absorbent filter 265, and only the carrier vapor V is heated by the heater 263 and converted into water and carbon dioxide, in the oxidation catalyst carrying medium 264.

Figure 5:
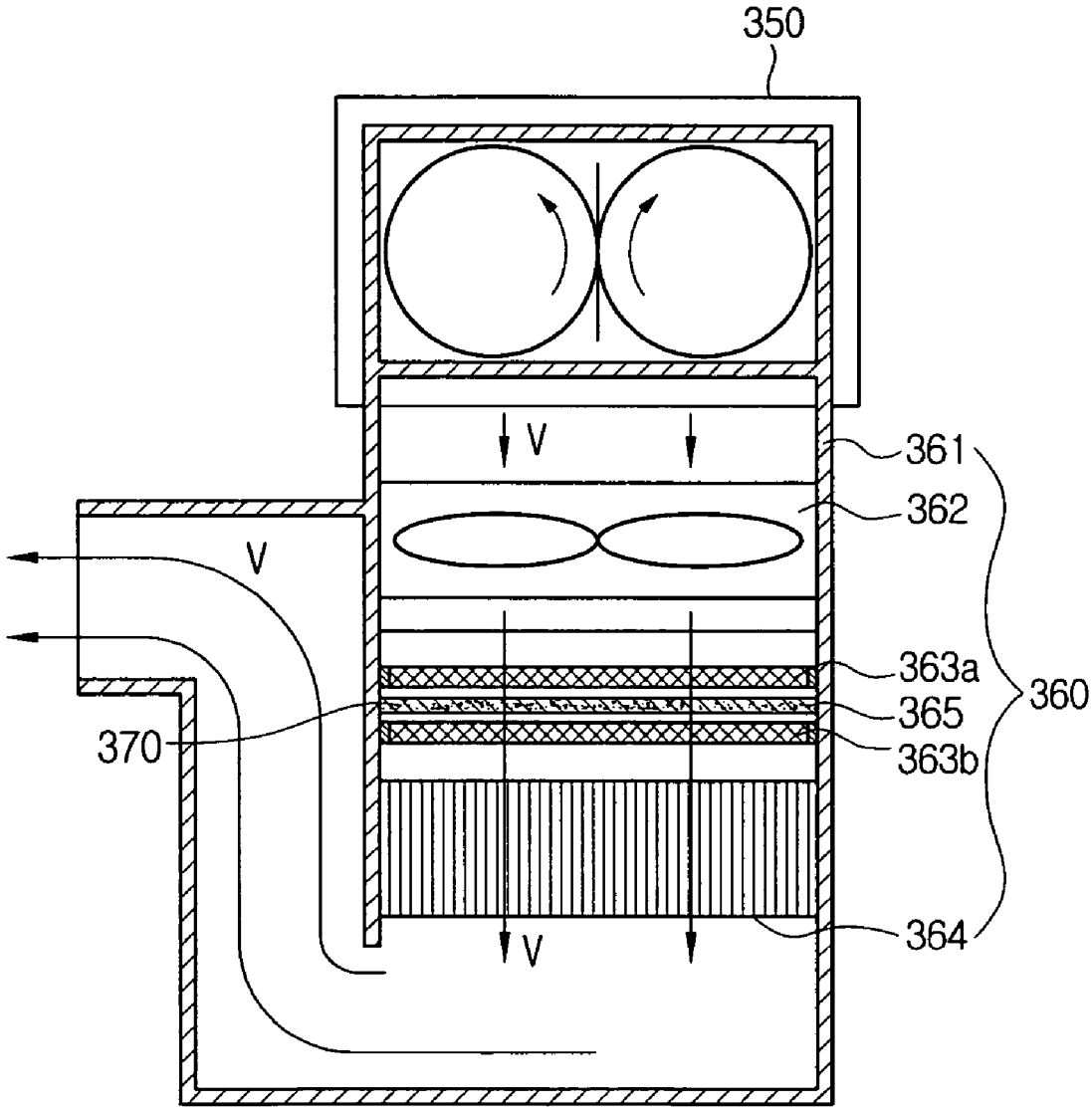
FIG. 5 is a sectional view illustrating an oxidation catalyst according to another embodiment of the present invention.

FIG. 5 is a sectional view of an oxidation catalyst unit according to another embodiment of the present invention. The oxidation catalyst unit 360 comprises a duct 361, a fan 362, first and second heaters 363*a* and 363*b*, an absorbent filter 365 and an oxidation catalyst carrying medium 364.

The duct 361 is connected to a fusing unit 350 to guide the carrier vapor V produced at the fusing unit 350 into the oxidation catalyst unit 360.

The fan 362 is mounted at an inlet of the duct 361 to forcibly send the carrier vapor V produced at the fusing unit 350 to the oxidation catalyst carrying medium 364.

The first and the second heaters 363*a* and 363*b* are mounted behind the fan 362 to heat the carrier vapor V passed through the absorbent filter 365.

The absorbent filter 365 is mounted in the duct 361 between the first heater 363*a* and the second heater 363*b* to prevent entry of the carrier vapor V, in the form of liquid drops 370, into the oxidation catalyst carrying medium 364.

The oxidation catalyst carrying medium 364 is mounted in the duct 361 behind the second heater 363*b* to catalyze an oxidation reaction of the carrier vapor V.

The absorbent filter 365 comprises one of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$, or a compound comprising at least two of zeolite, $\gamma$-$Al_2O_3$, $\gamma$-$TiO_2$, $\gamma$-$SiO_2\gamma$-$ZrO_2$ and $\gamma$-$SiO_2$—$Al_2O_3$.

According to the above structure, when the paper P passes through the fusing unit 350, the toner in the developers is affixed onto the paper P while the liquid carrier such as norpar is vaporized in the form of a combustible hydrocarbon gas such as $CH_4$ by a high temperature.

The carrier vapor V is guided into the oxidation catalyst unit 360 along the duct 361 connected to the fusing unit 350. The fan 362 in the oxidation catalyst unit 360 forcibly sends the carrier vapor V toward the first heater 363*a*.

After the carrier vapor V passes through the first heater 363*a*, the liquid drops 370 formed by the carrier vapor V which is partially condensed in the duct 361 is absorbed into the absorbent filter 365 disposed between the first heater 363*a* and the second heater 363*b*, and only the carrier vapor V is heated by the second heater 363*b* and converted into water and carbon dioxide in the oxidation catalyst carrying medium 364. Water and carbon dioxide are harmless to humans.

Figure 6A:
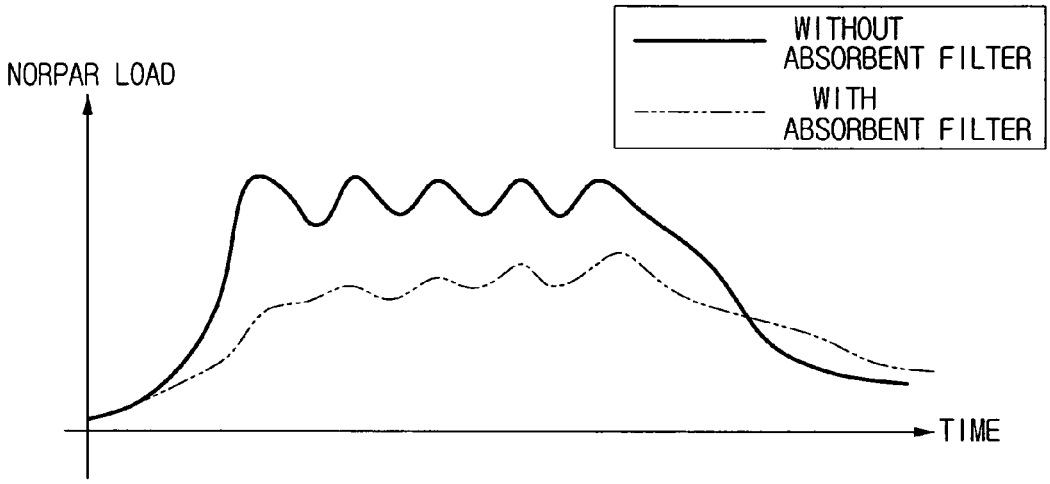
FIG. 6A is a graph illustrating temporal changes of a norpar load depending on an existence of an absorbent filter.
Figure 6B:
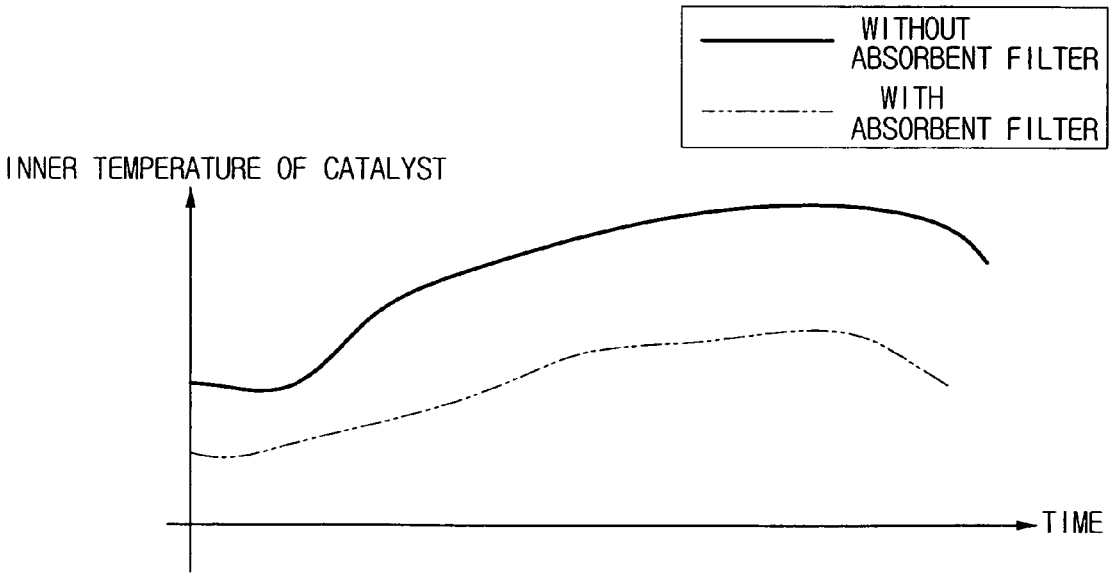
FIG. 6B is a graph illustrating temporal changes of an inner temperature of a catalyst depending on existence of an absorbent filter.

FIG. 6A is a graph showing temporal changes of a norpar load depending on the existence of an absorbent filter, and FIG. 6B is a graph showing temporal changes of an inner temperature of a catalyst depending on the existence of an absorbent filter.

Referring to FIGS. 6A and 6B, in the oxidation catalyst unit including the absorbent filter, the norpar load and the inner temperature of a catalyst for reaction are lower than those in the oxidation catalyst unit without the absorbent filter.

The norpar load refers to a load applied to the catalyst to dispose of the carrier vapor V (FIG. 4). Therefore, the more carrier vapor V that exists, the more norpar load that is applied to the catalyst.

In the oxidation catalyst unit 160 (FIG. 1) without an absorbent filter, when the carrier vapor V (FIG. 1) is excessively generated during the fusing process, all the carrier vapor V proceeds into the oxidation catalyst carrying medium 164 (FIG. 1) as it is. Accordingly, the norpar load and the inner temperature of catalyst for reaction increases.

Figure 1:
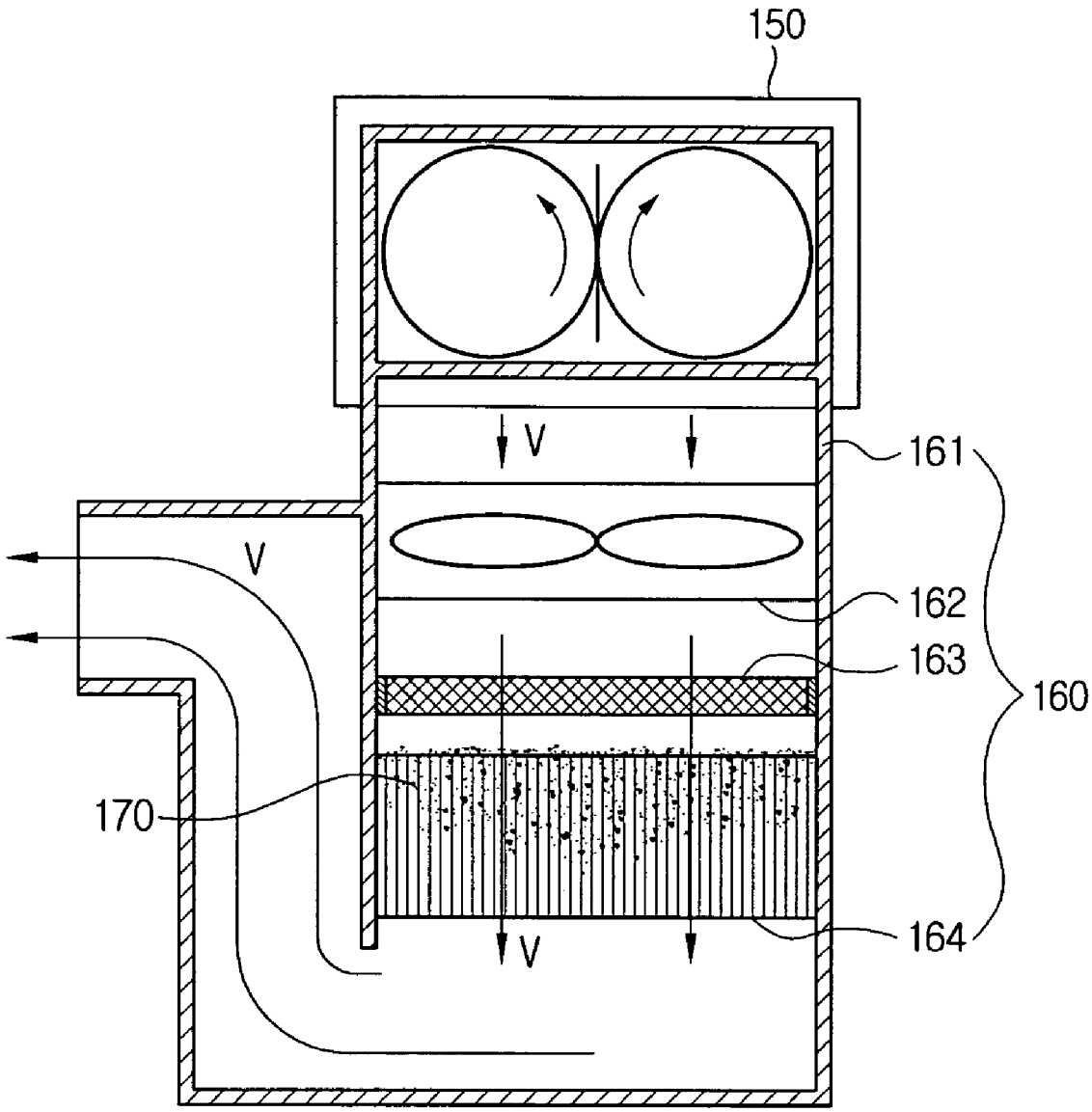
FIG. 1 (PRIOR ART)
FIG. 1 is a schematic view illustrating a conventional oxidation catalyst unit.

Furthermore, in the oxidation catalyst unit 160 (FIG. 1) without an absorbent filter, part of the carrier vapor V (FIG. 1) generated during the fusing process is cooled and condensed within the duct 161 (FIG. 1) while moving to the oxidation catalyst unit 160 (FIG. 1). Even after passing through the heater 163 (FIG. 1) of the oxidation catalyst unit 160, the carrier vapor V is not completely vaporized but proceeds into the oxidation catalyst carrying medium 164 (FIG. 1) in the form of the liquid drops 170 (FIG. 1), thereby being absorbed in the surface of the catalyst in the oxidation catalyst carrying medium 164 (FIG. 1).

Therefore, the malfunctioning part of the catalyst gradually increases, and as a result, the norpar load and the inner temperature of the catalyst become larger than those of the oxidation catalyst unit having the absorbent filter.

On the contrary, in the oxidation catalyst 260 (FIG. 4) including the absorbent filter 265 (FIG. 4), the absorbent filter 265 (FIG. 1) can absorb the carrier vapor V (FIG. 4) that is generated during the fusing process. Therefore, the carrier vapor V in the form of the liquid drops 270 (FIG. 1) is prevented from being absorbed into the oxidation catalyst carrying medium 264 (FIG. 4), and a moderate amount of the carrier vapor V proceeds into the oxidation catalyst carrying medium 264 (FIG. 4). As a result, the norpar load and the inner temperature of the catalyst for reaction can be lowered.

Besides adopting the absorbent filter, the volume of the heater or the catalyst can be enlarged for the same effect. However, the norpar load applied to the catalyst is the highest when printing an image having a large area to cover, after warming-up of the apparatus. Because the oxidation catalyst reaction is an exothermic reaction, the inner temperature of the catalyst becomes high enough henceforth, thereby enabling a stable reaction of the catalyst. Therefore, the absorbent filter is most effective in primarily absorbing excessive initial norpar and stabilizing the oxidation reaction.

As can be appreciated from the above description, by using the oxidation catalyst unit and the wet-type electrophotographic image forming apparatus having the same according to embodiments of the present invention, efficiency and stability of the oxidation catalyst unit can be improved.

While the invention has been shown and described with reference to certain embodiments thereof, it should be understood by those skilled in the art that various changes in form and details may be made therein without departing from the spirit and scope of the invention as defined by the appended claims.

What is claimed is:

1. An oxidation catalyst unit for a wet-type electrophotographic image forming apparatus which filters a vapor produced at a fusing unit, the oxidation catalyst unit comprising:

a duct for guiding the carrier vapor produced at the fusing unit into the oxidation catalyst unit;

a heater for heating the carrier vapor being guided along the duct;

a oxidation catalyst carrying medium disposed behind the heater for catalyzing an oxidation reaction of the carrier vapor guided along the duct; and an absorbent filter for passing the carrier vapor while absorbing liquid drops formed by the carrier vapor.

2. The oxidation catalyst unit of claim 1, wherein the absorbent filter comprises one of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

3. The oxidation catalyst unit of claim 1, wherein the absorbent filter comprises a compound comprising at least two of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

4. The oxidation catalyst unit of claim 1, wherein the absorbent filter is disposed before the heater.

5. The oxidation catalyst unit of claim 1, wherein the absorbent filter is disposed between the heater and the oxidation catalyst carrying medium.

6. The oxidation catalyst unit of claim 1, wherein a plurality of heaters are provided.

7. The oxidation catalyst unit of claim 6, wherein the absorbent filter is disposed between the plurality of heaters.

8. The oxidation catalyst unit of claim 1, wherein the absorbent filter substantially prevents entry of the liquid drops into the oxidation catalyst carrying medium.

9. A wet-type electrophotographic image forming apparatus comprising:

a photoconductive medium;

a laser scanning unit for scanning a laser beam onto the photoconductive medium;

a developing unit for developing a developer onto the photoconductive medium;

a transfer unit for transferring the developed developer to a paper;

a fusing unit for fusing the developer onto the paper; and an oxidation catalyst unit for oxidizing and removing a carrier vapor produced at the fusing unit, wherein the oxidation catalyst unit comprises:

a duct for guiding the carrier vapor produced at the fusing unit into the oxidation catalyst unit;

a heater for heating the carrier vapor being guided along the duct;

an oxidation catalyst carrying medium disposed behind the heater for catalyzing an oxidation reaction of the carrier vapor guided along the duct; and an absorbent filter for passing the carrier vapor while absorbing liquid drops formed by the carrier vapor.

10. The wet-type electrophotographic image forming apparatus of claim 9, wherein the absorbent filter comprises one of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2\mathbf{0}_3$.

11. The wet-type electrophotographic image forming apparatus of claim 9, wherein the absorbent filter comprises a compound comprising at least two of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

12. The wet-type electrophotographic image forming apparatus of claim 9, wherein the absorbent filter is disposed before the heater.

13. The wet-type electrophotographic image forming apparatus of claim 9, wherein the absorbent filter is disposed between the heater and the oxidation catalyst carrying medium.

14. The wet-type electrophotographic image forming apparatus of claim 9, wherein a plurality of heaters are provided.

15. The wet-type electrophotographic image forming apparatus of claim 14, wherein the absorbent filter is disposed between the plurality of heaters.

16. The wet-type electrophotographic image forming apparatus of claim 9, wherein the absorbent filter substantially prevents entry of the liquid drops into the oxidation catalyst carrying medium.

17. A method of filtering a carrier vapor produced at a fusing unit of a wet-type electrophotographic image forming apparatus, the method comprising:

guiding the carrier vapor produced at the fusing unit into a oxidation catalyst unit via a duct;

heating the carrier vapor being guided along the duct via a heater;

catalyzing an oxidation reaction of the carrier vapor guided along the duct via an oxidation catalyst carrying medium disposed behind the heater; and passing the carrier vapor while absorbing liquid drops formed by the carrier vapor via an absorbent filter.

18. The method of claim 17, wherein the absorbent filter comprises one of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

19. The method of claim 17, wherein the absorbent filter comprises a compound comprising at least two of zeolite, $\gamma$-$Al_2O_3$, $\gamma$-$TiO_2$, $\gamma$-$SiO_2$, $\gamma$-$ZrO_2$ and $\gamma$-$SiO_2$—$Al_2O_3$.

20. The method of claim 17, wherein the absorbent filter is disposed before the heater.

21. The method of claim 17, wherein the absorbent filter is disposed between the heater and the oxidation catalyst carrying medium.

22. The method of claim 17, wherein a plurality of heaters are provided.

23. The method of claim 22, wherein the absorbent filter is disposed between the plurality of heaters.

24. The method of claim 22, wherein the absorbent filter substantially prevents entry of the liquid drops into the oxidation catalyst carrying medium.

* * * * *